US005725192A

United States Patent [19]

Cloninger

[11] Patent Number: 5,725,192

[45] Date of Patent: Mar. 10, 1998

[54] ADJUSTABLE ARTIST'S EASEL

[76] Inventor: Robert E. Cloninger, 745 Ashebrook Park Rd., Dallas, N.C. 28034

[21] Appl. No.: 701,241

[22] Filed: Aug. 22, 1996

[51] Int. Cl.[6] ..... A47B 97/04

[52] U.S. Cl. ..... 248/458; 248/447; 248/455

[58] Field of Search ..... 248/458, 441.1, 248/447, 460, 454, 455

[56] References Cited

U.S. PATENT DOCUMENTS

| | | | |
|---|---|---|---|
| 2,191,755 | 2/1940 | Dearing | 248/454 |
| 2,550,550 | 4/1951 | Goodstein | 248/195 |
| 2,744,712 | 5/1956 | Brandt | 248/166 |
| 3,095,665 | 7/1963 | Killen | 248/455 |
| 3,145,966 | 8/1964 | Landon | 248/464 |
| 3,368,786 | 2/1968 | Bulman | 248/455 |
| 3,738,606 | 6/1973 | Millen | 248/449 |
| 3,809,354 | 5/1974 | Phifer | 248/455 |
| 3,926,398 | 12/1975 | Vincent | 248/448 |
| 4,022,418 | 5/1977 | Kellner | 248/460 |
| 4,057,215 | 11/1977 | Stettler | 248/460 |
| 4,134,614 | 1/1979 | Fielding, Sr. | 248/458 |
| 4,165,856 | 8/1979 | Wiseheart | 248/458 |
| 4,453,470 | 6/1984 | Capella | 248/464 X |
| 4,482,185 | 11/1984 | Zoellner | 297/135 |
| 4,690,363 | 9/1987 | Koves | 248/449 |
| 4,856,749 | 8/1989 | Habermann | 248/460 |
| 5,016,852 | 5/1991 | Herendeen | 248/455 |
| 5,074,513 | 12/1991 | Presley et al. | 248/454 |
| 5,308,035 | 5/1994 | Ross | 248/454 |
| 5,337,996 | 8/1994 | Kalish | 248/460 |

*Primary Examiner*—Leslie A. Braun
*Assistant Examiner*—Anita M. King
*Attorney, Agent, or Firm*—Adams Law Firm, P.A.

[57] ABSTRACT

An adjustable easel is provided for supporting an artist's canvas. The easel includes a base, and a rotatably adjustable canvas frame attached to the base for engaging the canvas and holding the canvas in a stable condition for painting. A mounting pin interconnects the base and the canvas frame together, and defines an axis of rotation about which the canvas frame rotates relative to the base. A lock assembly cooperates with the mounting pin for releasibly locking the canvas frame in one of a plurality of predefined positions relative to the base.

15 Claims, 9 Drawing Sheets

ADJUSTABLE ARTIST'S EASEL

TECHNICAL FIELD AND BACKGROUND OF THE INVENTION

This invention relates to an artist's easel for supporting a canvas. The term "canvas" is used broadly herein to describe any structure having a painting surface, such as wood, masonite, or glass. The invention is adjustable in a forward and rearward direction to change the angle of the canvas relative to the artist, and includes a frame for rotating the canvas about an axis perpendicular to the frame. The invention may further include accessories, such as an attached light fixture and a table for painting equipment, such as paint cans and brushes.

Conventional artist's easels include a supporting base, such as a tripod and a frame attached to the base for holding the canvas. Although the frame is generally adjustable in up/down and sideways directions to fit the dimensions of the particular canvas, such easels typically do not allow rotation of the canvas relative to the artist. The artist is thus required to adjust his position to accommodate the fixed position of the canvas when painting. This generally becomes awkward and uncomfortable over a relatively short time.

The present invention addresses this and other problems of the prior art by providing an easel which allows ready and convenient adjustment of the position of the canvas to suit the individual artist. The frame of the easel is pivotable in a forward and rearward direction, and is rotatable about an axis perpendicular to the frame. A locking assembly permits releasible locking of the frame in one of a number of rotatably adjusted positions.

SUMMARY OF THE INVENTION

Therefore, it is an object of the invention to provide an artist's easel which is pivotably adjustable in a forward and rearward direction relative to the artist.

It is another object of the invention to provide an artist's easel which is rotatable about an axis perpendicular to the frame of the easel.

It is another object of the invention to provide a artist's easel which includes a locking assembly for releasibly locking the canvas frame in one of a number of alternate positions.

It is another object of the invention to provide a artist's easel which includes a locking assembly that allows quick and convenient adjustment of the position of the canvas, while holding the canvas in a stable condition when painting.

It is another object of the invention to provide an artist's easel which includes a locking assembly that is automatically operable upon rotation of the canvas frame.

These and other objects of the present invention are achieved in the preferred embodiments disclosed below by providing an adjustable easel for supporting an artist's canvas. The easel includes a base, and a rotatably adjustable canvas frame attached to the base for engaging the canvas and holding the canvas in a stable condition for painting. A mounting pin interconnects the base and the canvas frame together, and defines an axis of rotation about which the canvas frame rotates relative to the base. Lock means cooperates with the mounting pin for releasibly locking the canvas frame in one of a plurality of predefined positions relative to the base.

According to one preferred embodiment of the invention, the base includes a pair of spaced-apart front legs, a horizontal cross bar connecting the front legs together, and a rear leg attached to the cross bar.

According to another preferred embodiment of the invention, a table frame is secured to the front and rear legs of the base to support a table in a generally level condition for holding painting articles.

According to yet another preferred embodiment of the invention, pivot means are provided for pivotably attaching the rear leg to the cross bar to permit folding of the base for storage.

According to yet another preferred embodiment of the invention, the base further includes a base frame. The base frame includes spaced-apart top and bottom segments and spaced-apart side segments attached to the top and bottom segments. The bottom segment includes opposing end pins engaging the front legs of the base to support the base frame in a generally upright position.

According to yet another preferred embodiment of the invention, the front legs include respective support hooks for engaging the pins of the bottom segment of the base frame.

According to yet another preferred embodiment of the invention, a light fixture is mounted to the top segment of the base frame.

According to yet another preferred embodiment of the invention, the base frame includes a vertical center support attached to the top and bottom segments and located between the side segments. The mounting pin is secured to the center support and to the canvas frame for attaching the canvas frame to the base frame.

According to yet another preferred embodiment of the invention, the base frame includes adjustable top and bottom canvas holders removably attached to the vertical center support of the base frame for engaging and holding the canvas.

According to yet another preferred embodiment of the invention, a spacer is attached to the cross bar and to the vertical center support of the base frame to further support the base frame in a generally upright position.

According to yet another preferred embodiment of the invention, the length of the spacer is adjustable to allow forward and rearward pivoting movement of the base frame.

According to yet another preferred embodiment of the invention, the canvas frame includes an adjustable cross arm with spaced-apart canvas holders located at respective opposite ends of the cross arm for engaging and holding the canvas.

According to yet another preferred embodiment of the invention, the cross arm includes first and second spaced-apart, parallel segments received for individual sliding movement within respective sleeves. The sleeves are joined together at a center section connected to a proximate end of the mounting pin for rotational movement about the axis defined by the mounting pin.

BRIEF DESCRIPTION OF THE DRAWINGS

Some of the objects of the invention have been set forth above. Other objects and advantages of the invention will appear as the description proceeds when taken in conjunction with the following drawings, in which.

DESCRIPTION OF THE PREFERRED EMBODIMENT AND BEST MODE

Figure 1:
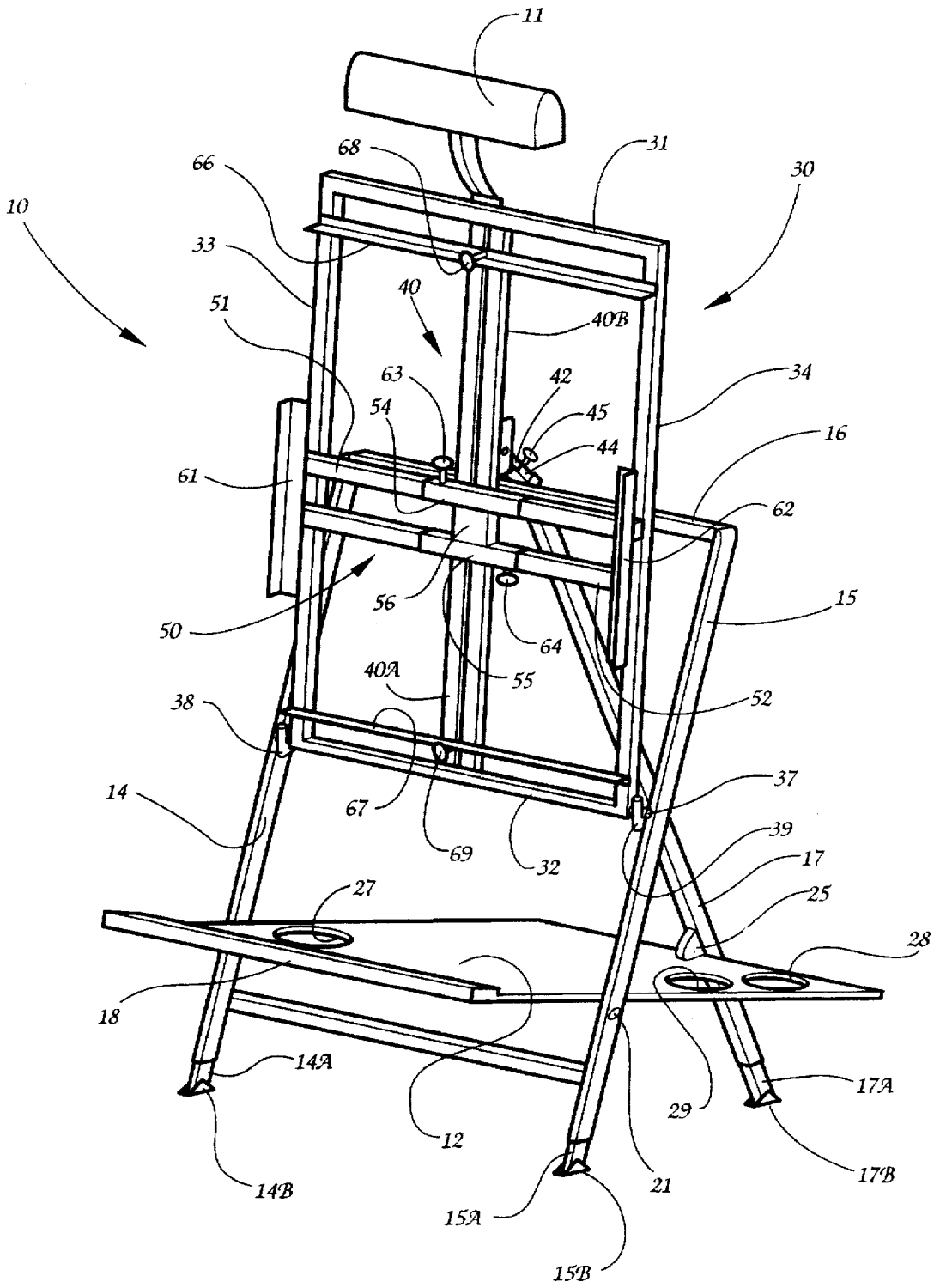
FIG. 1 is a perspective view of the artist's easel according to one preferred embodiment of the present invention.

Referring now specifically to the drawings, an adjustable easel according to the present invention is illustrated in FIG. 1 and shown generally at reference numeral 10. The easel 10 is used for supporting an artist's canvas, as broadly defined, in a generally upright, front-facing position for painting, and may include accessories, such as a detachable light fixture 11 and table 12 for holding painting articles.

Figure 2:
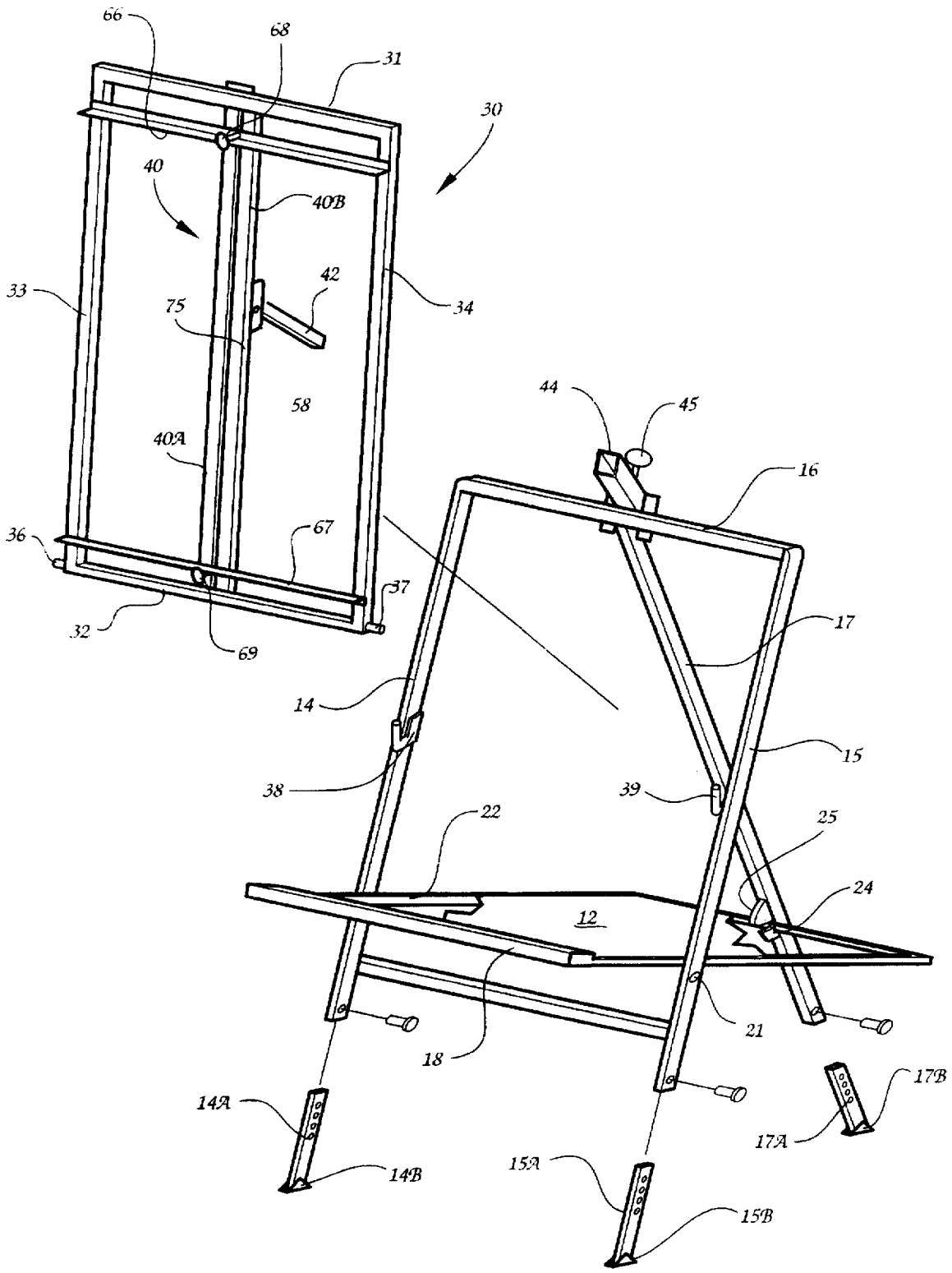
FIG. 2 is a perspective view of the base of the easel with the base frame removed from the legs.

Referring to FIGS. 1 and 2, the easel 10 is formed of a base having spaced-apart front legs 14 and 15 joined together by a cross bar 16, and a rear leg 17 pivotably attached to the cross bar 16 to allow folding of the easel 10 for convenient transport and storage. The legs 14, 15, and 17 are preferably hollow, and include respective telescoping members 14A, 15A, and 17A for allowing height adjustment of the base. The legs 14, 15, and 17 further include respective pivoted feet 14B, 15B, and 17B for stabilizing the base on the ground surface.

A table frame 18 is pivotably attached to the front legs 14 and 15 by pins 21 and 22, and engages a catch 24 located on the rear leg 17 to define a support for carrying the table 12. When the table 12 is placed on the frame 18, as shown in FIGS. 1 and 2, a pivoted bar 25 engages the frame 18 and cooperates with the catch 24 to maintain the table 12 in stable and level condition suitable for supporting paint containers and the like. The table 12 preferably includes one or more circular cut-outs 27, 28, and 29 for receiving and holding the paint containers (not shown). For storage or transport of the easel 10, the bar 25 is pivotable in a direction towards the rear leg 17, thereby allowing the table frame 18 to pivot upwardly from the rear leg 17 towards the front legs 14 and 15 for folding.

As best shown in FIG. 2, the base of the easel 10 further includes a base frame 30 formed of spaced-apart top and bottom segments 31 and 32, and vertical side segments 33 and 34 attached to the top and bottom segments 31, 32. The bottom segment 32 includes opposing end pegs 36 and 37 for resting on hooks 38 and 39 attached to the front legs 14 and 15 to support the base frame 30. A center support 40 formed of slightly spaced vertical segments 40A and 40B is connected to the top and bottom segments 31 and 32, and includes a pivotably attached spacer 42 for being received into an open ended hollow tube 44 attached to the cross bar 16. A threaded pin 45 enters the tube 44 through a complementary threaded opening (not shown), and engages the spacer 42 when tightened to prevent sliding movement of the spacer 42 within the tube 44. The tilt of the base frame 30 is adjustable in a forward and rearward direction by adjusting the length of the spacer 42 received within the tube 44.

Figure 3:
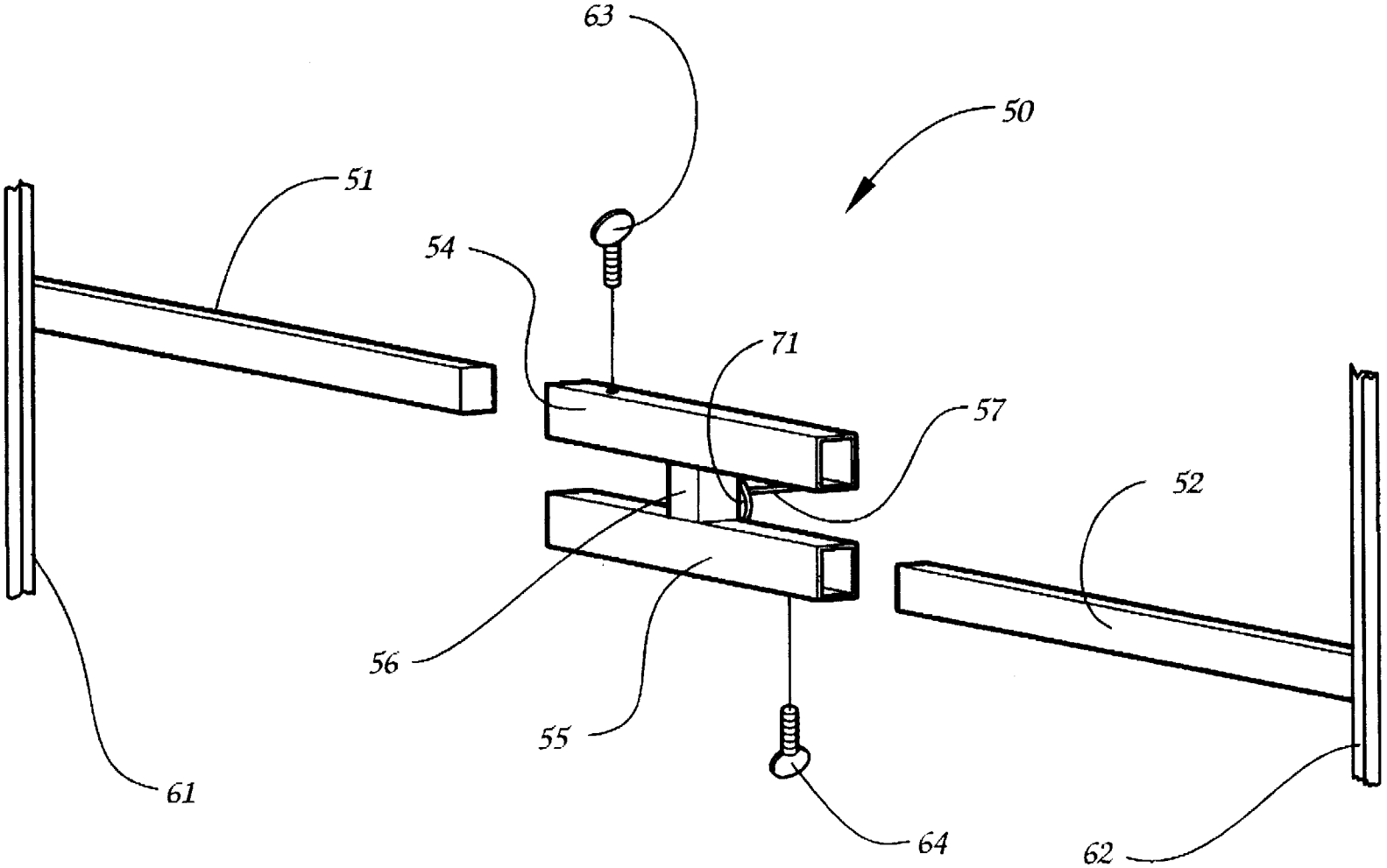
FIG. 3 is a perspective view of the canvas frame with elements of the cross arm exploded.
Figure 4:
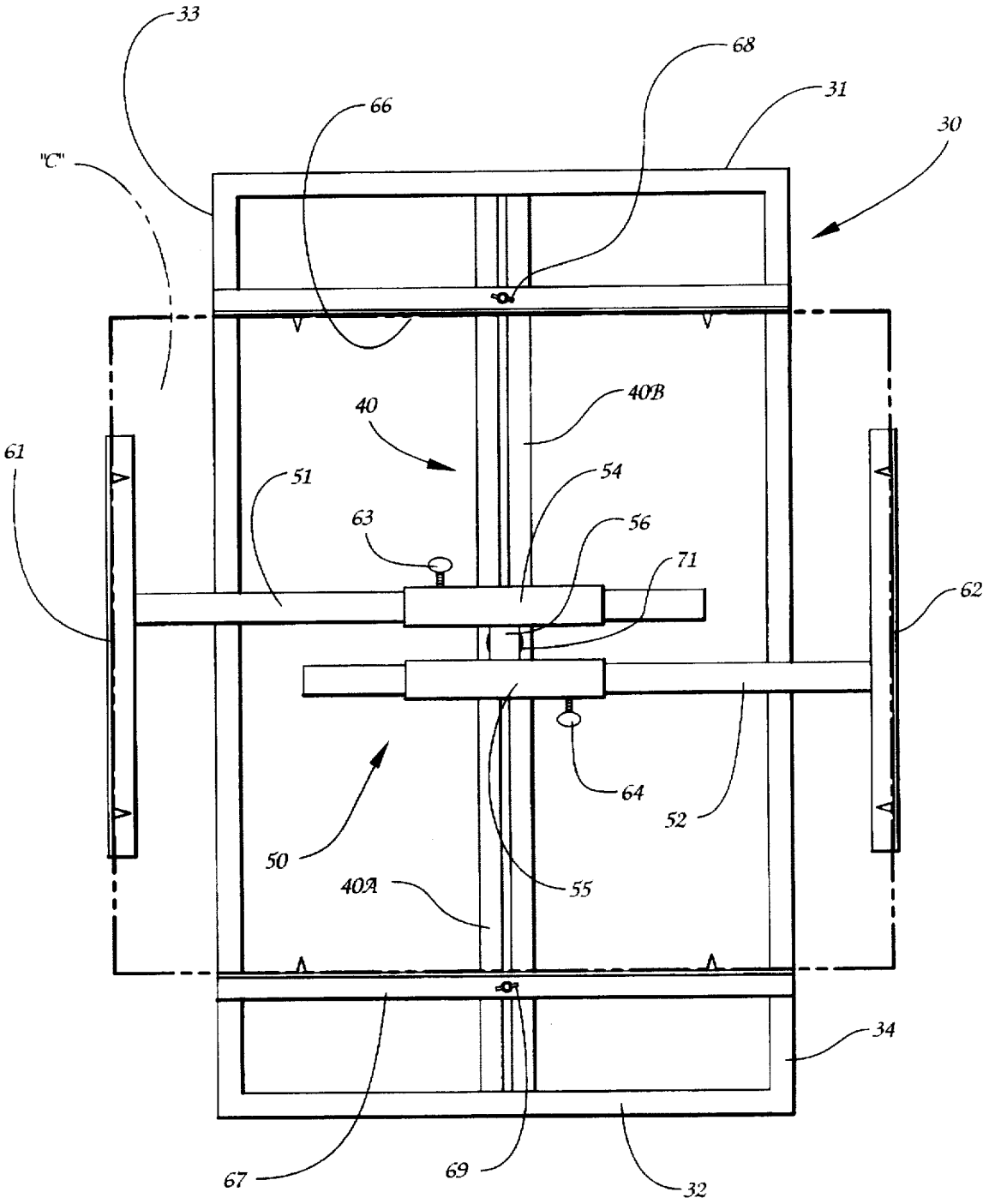
FIG. 4 is a front view of the canvas frame mounted to the base frame, and showing the canvas in phantom supported in a first position for painting.
Figure 5:
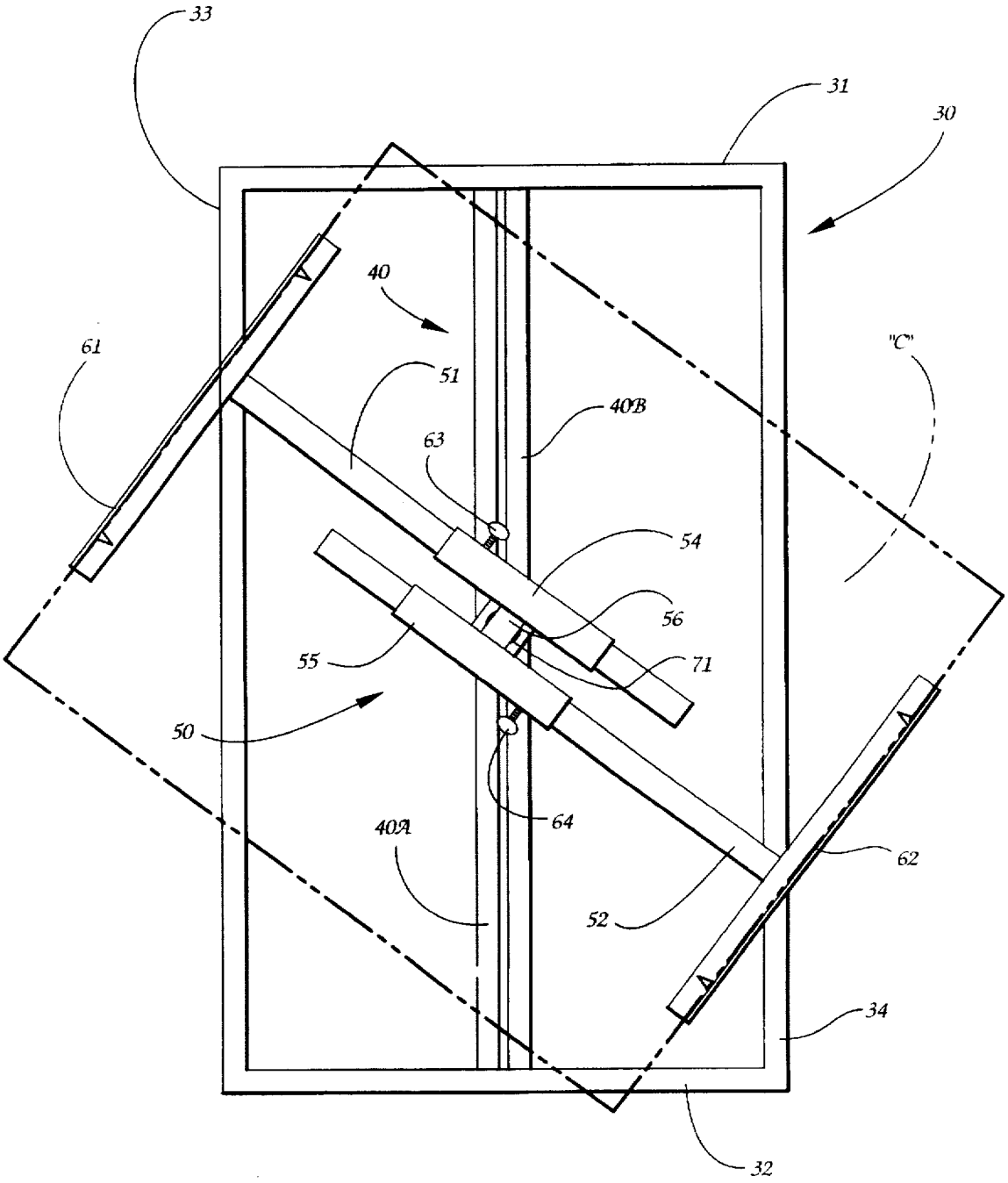
FIG. 5 is a front view of the canvas frame mounted to the base frame, and showing the canvas in phantom supported in a second position for painting.

Referring to FIGS. 3, 4, and 5, a canvas frame 50 is attached to the base frame 30 for holding the canvas "C" in a desired position for painting. The canvas frame 50 includes an adjustable cross arm having parallel segments 51 and 52 received for individual sliding movement within hollow sleeves 54 and 55 joined together at a center section 56, as best illustrated in FIG. 3. A mounting pin 57 is fixed to the center section 56 by welding or other suitable means, and extends through a stationary hollow cylinder 58 (See FIG. 2) located between the segments 40A and 40B of the center support 40. The mounting pin 57 defines an axis of rotation about which the canvas frame 50 rotates relative to the base frame 30.

A pair of canvas holders 61 and 62 are located on respective outer ends of the segments 51 and 52 for mounting the canvas "C" to the easel 10. After adjusting to fit the canvas "C", the distance between the holders 61 and 62 is set by threaded pins 63 and 64 which enter the hollow sleeves 54 and 55 when tightened to engage the segments 51 and 52. Preferably, a second pair of canvas holders 66 and 67 are attached to the vertical center support 40 of the base frame 30. These canvas holders 66 and 67 are removable and adjustable along the length of the center support 40 using threaded pins 68 and 69 and corresponding bolts (not shown).

According to one manner of using the easel 10, the artist mounts the canvas "C" on the canvas frame 50 between the holders 61, 62, 66, and 67, as shown in FIG. 4. The position of the canvas "C" relative to the artist is adjustable by sliding the spacer 42 within the hollow tube 44, and tilting the base frame 30 in a forward and rearward direction as described above. When the desired angle of the canvas "C" is achieved, the pin 45 is tightened and the spacer 42 secured in a fixed position.

According to another use of the easel 10, shown in FIG. 5, the canvas "C" is mounted on the canvas frame 50 between the holders 61 and 62, and the holders 66 and 67 of the base frame 30 removed by unscrewing the threaded pins 68 and 69. The forward and rearward tilt of the base frame 30 is adjustable as described above. With the holders 66 and 67 removed, the canvas frame 50 is also rotatable about the axis of the mounting pin 57, thus allowing rotatable adjustment of the canvas "C" between a number of predefined working positions. A lock assembly, described below, operates to releasibly lock the canvas frame 50 in a desired one of these working positions to stabilize the canvas "C" when painting.

Figure 6:
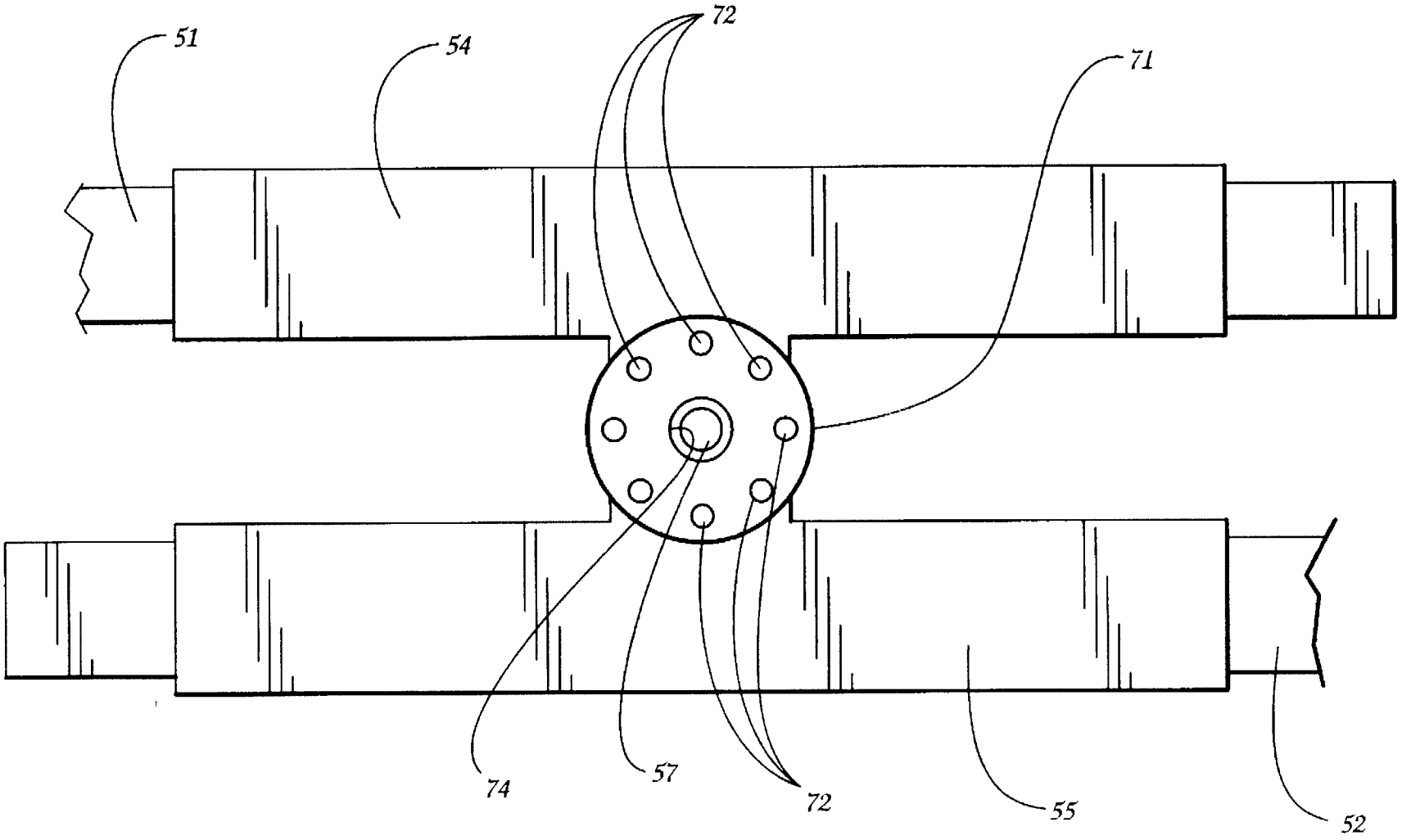
FIG. 6 is a fragmentary view of the back side of the canvas frame.
Figure 7:
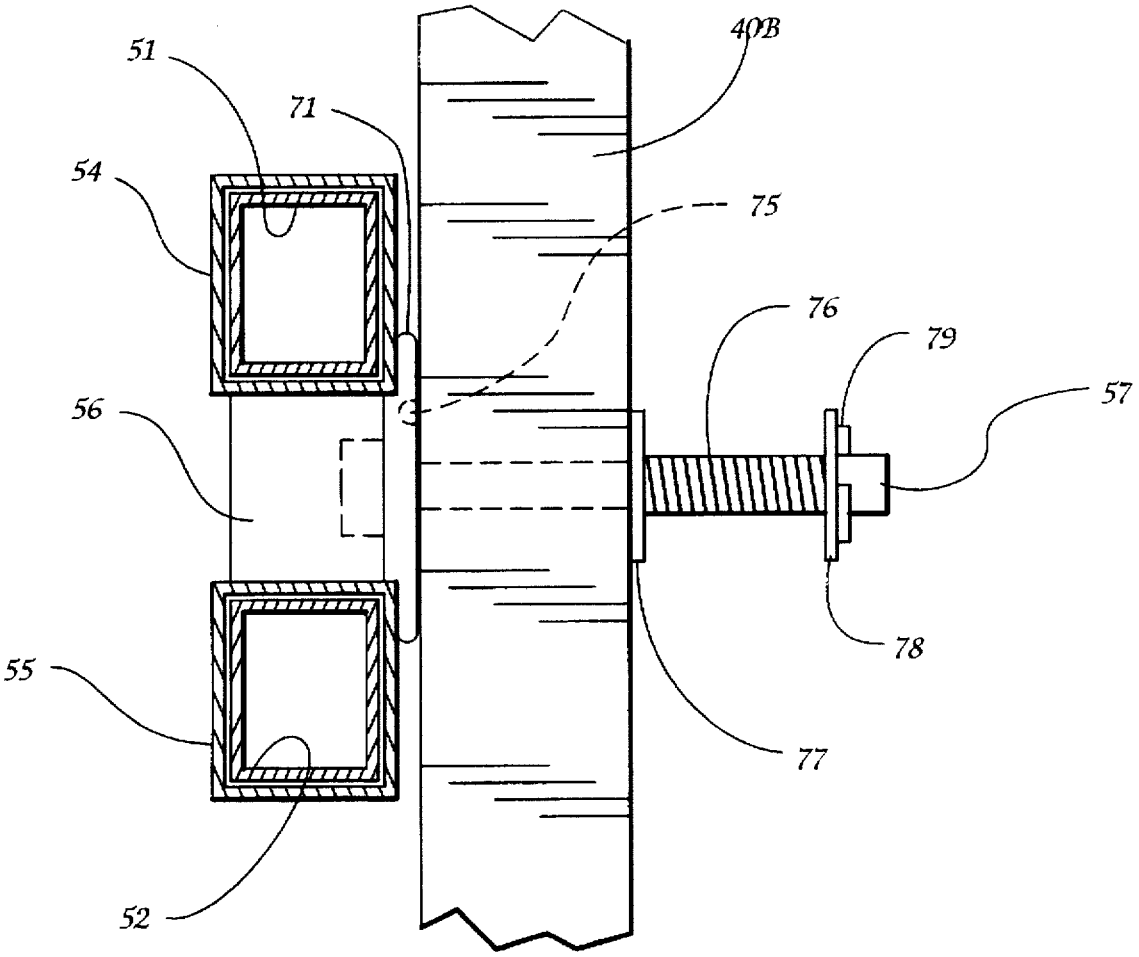
FIG. 7 is a fragmentary cross-sectional view of the canvas frame as attached to the base frame, and showing the canvas frame in a releasibly locked position for painting.
Figure 8:
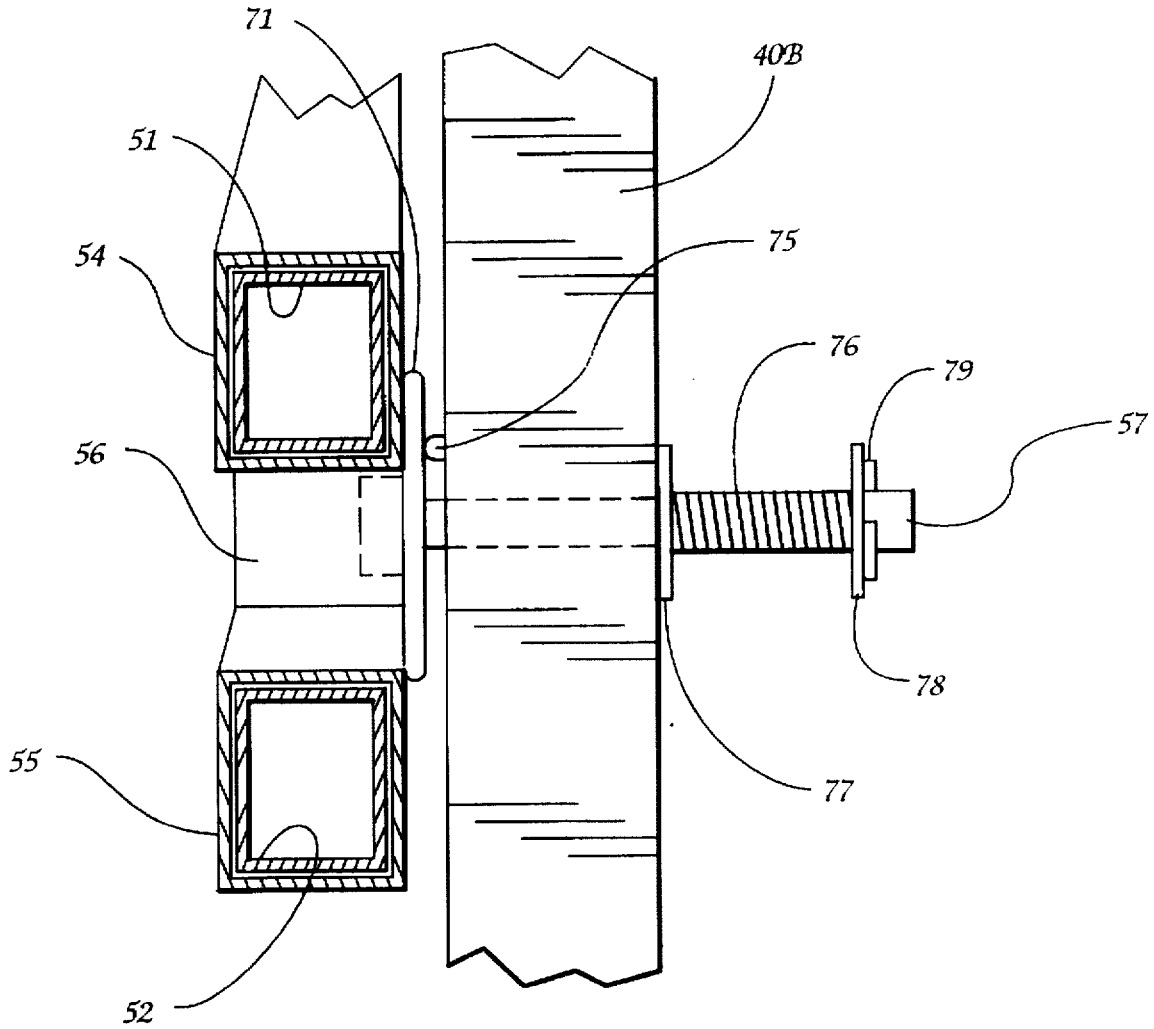
FIG. 8 is a fragmentary cross-sectional view of the canvas frame as attached to the base frame, and showing the canvas frame between releasibly locked positions.

Referring to FIGS. 6, 7, and 8, the lock assembly includes a relatively thin disk 71 with spaced-apart openings 72 formed in a circular path around its outer edge, and a larger center opening 74 for receiving the mounting pin 57 of the canvas frame 50. The disk 71 is permanently fixed to a back side of the center section 56, as shown in FIG. 6, by an adhesive or other suitable means. When the canvas frame 50 is attached to the center support 40, as shown in FIGS. 7 and 8, the openings 72 of the disk 71 selectively align with a small bead 75 formed to the segment 40B. The canvas frame 50 is biased against the base frame 30 by a compressed spring 76 located between washers 77 and 78 on a free end of the mounting pin 57. A cotter pin 79 or the like retains the spring 76 and washers 77, 78 on the mounting pin 57.

In the position of FIG. 7, the bead 75 is received within one of the openings 72 of the disk 71, and cooperates with the spring 76 to hold the canvas frame 50 sufficiently stable to prevent shifting of the canvas during painting. To change this orientation of the canvas, the artist rotates the canvas frame 50, thus moving the selected opening 72 of the disk 71 out of mating alignment with the bead 75, as shown in FIG. 8. The spring 76 allows slight separation of the canvas frame 50 from the center support 40 until the bead 75 re-aligns with another opening 72. Each opening 72 of the disk 71 thus represents an alternative position of the canvas frame 50 relative to base frame 30. The stability of the canvas frame 50 in each of these positions can be increased as desired by selecting a spring 76 with the appropriate strength and dimensions.

According to an alternative embodiment (not shown), the disk is attached directly to the center support of the base frame, and a spring-loaded protruding head positioned within the center section of the canvas frame. The mounting pin and compression spring cooperate, as described above, to attach the canvas frame to the base frame and to urge the protruding head into selective alignment with the openings of the disk as the canvas frame is rotated.

Figure 9:
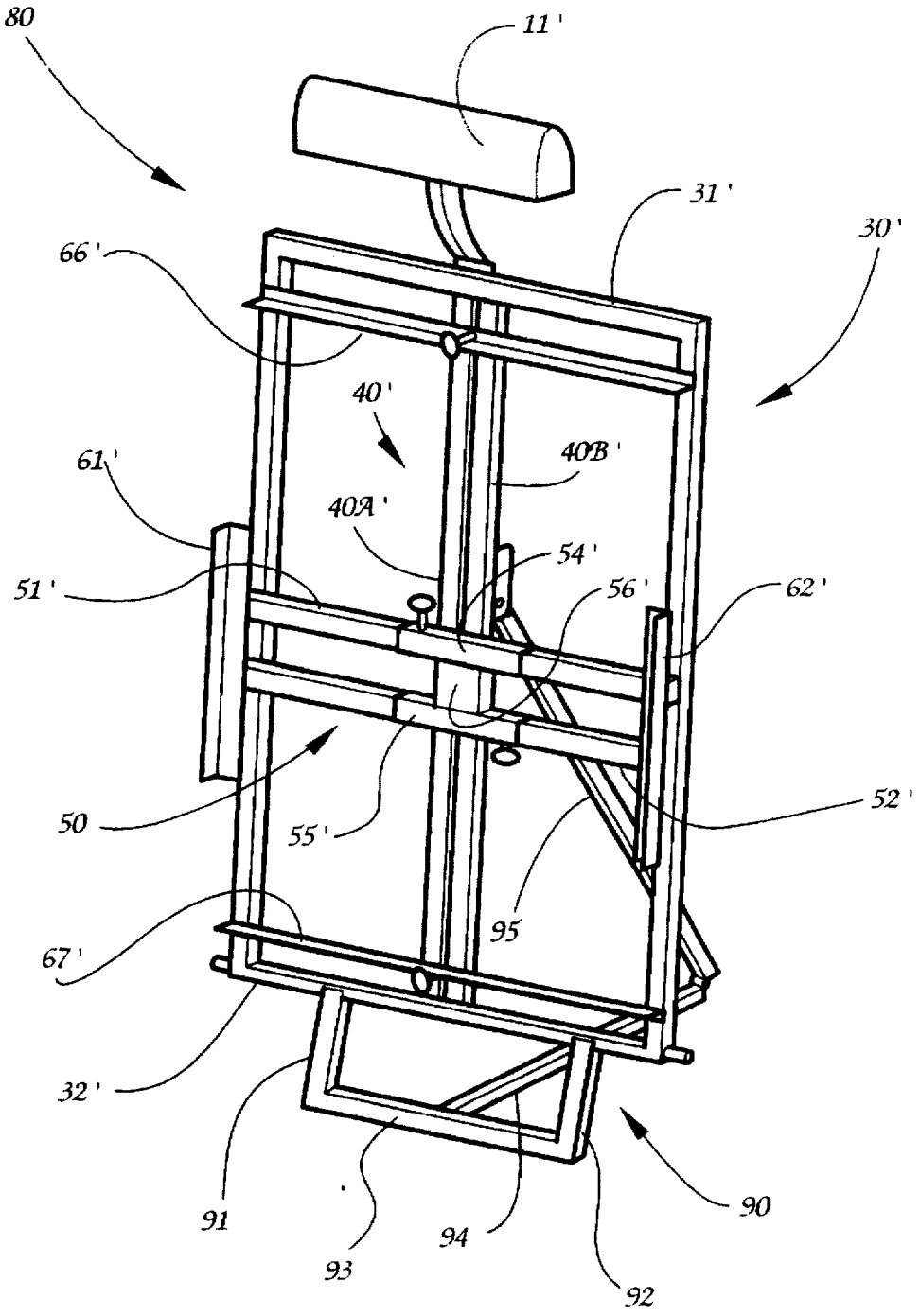
FIG. 9 is a perspective view of an alternative embodiment of the artist's easel.

A further embodiment of the invention is shown in FIG. 9. Like elements referred to above are shown in prime notation. The easel 80 includes a base frame 30' formed of spaced-apart top and bottom segments 31' and 32', and vertical side segments 33' and 34' attached to the top and bottom segments 31', 32'. A center support 40' formed of slightly spaced vertical segments 40A' and 40B' is connected to the top and bottom segments 31' and 32'. In addition, a light fixture 11' may be attached to the top segment 31.

The base frame 30' is supported on a surface, such as a desk top or table, by a base 90 with front vertical legs 91 and 92 engaging the bottom segment 32' and connected together by a horizontal segment 93. A second segment 94 extends perpendicular to the segment 93, and is pivotably attached at an end to an arm 95. The arm 95 is connected to the center support 40' of the base frame 30' with a removable pin 96. Preferably, the arm 95 includes telescoping sections to allow length adjustment, thereby adjusting the tilt angle of the base frame 30'.

As previously described, the canvas frame 50' is attached to the base frame 30' for holding the canvas in a desired position for painting. The canvas frame 50' includes an adjustable cross arm having parallel segments 51' and 52' received for individual sliding movement within hollow sleeves 54' and 55' joined together at a center section 56'. A mounting pin (not shown) is fixed to the center section 56' by welding or other suitable means, and extends through a stationary hollow cylinder located between the segments 40A' and 40B' of the center support 40'. The mounting pin defines an axis of rotation about which the canvas frame 50' rotates relative to the base frame 30'. A pair of canvas holders 61' and 62' are located on respective outer ends of the segments 51' and 52' for mounting the canvas to the easel 80. Preferably, a second pair of canvas holders 66' and 67' are attached to the vertical center support 40' of the base frame 30'.

An adjustable easel is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

I claim:

1. An adjustable easel for supporting an artist's canvas, comprising:

(a) a base including a pair of spaced-apart front legs, a horizontal cross bar connecting the front legs together, and a rear leg attached to the cross bar; and a base frame including spaced-apart top and bottom segments and spaced-apart side segments attached to the top and bottom segments, said bottom segment including opposing end pins engaging the front legs to support said base frame in an adjustable upright position;

(b) a rotatably adjustable canvas frame attached to the base frame for engaging the canvas and holding the canvas in a stable condition for painting;

(c) mounting means for interconnecting the base frame and the canvas frame together, and defining an axis of rotation about which the canvas frame rotates relative to the base frame; and (d) lock means cooperating with the mounting means for releasibly locking said canvas frame in one of a plurality of predefined positions relative to the base frame.

2. An adjustable easel according to claim 1, and including a table frame secured to the front and rear legs of said base to support a table in a generally level condition for holding painting articles.

3. An adjustable easel according to claim 1, and including pivot means for pivotably attaching the rear leg to the cross bar to permit folding of the base for storage.

4. An adjustable easel according to claim 1, wherein the front legs include respective support hooks for engaging the pins of the bottom segment of said base frame.

5. An adjustable easel according to claim 1, and including a light fixture mounted to the top segment of said base frame.

6. An adjustable easel according to claim 1, wherein said base frame comprises a vertical center support attached to the top and bottom segments and located between the side segments, and said mounting means comprising a mounting pin secured to the center support and said canvas frame for attaching said canvas frame to said base frame.

7. An adjustable easel according to claim 6, wherein said base frame includes adjustable top and bottom canvas holders removably attached to the vertical center support of said base frame for engaging and holding the canvas.

8. An adjustable easel according to claim 6, and including a spacer attached to the cross bar and to the vertical center support of said base frame to further support said base frame in a generally upright position.

9. An adjustable easel according to claim 8, wherein the length of said spacer is adjustable to allow forward and rearward pivoting movement of said base frame.

10. An adjustable easel according to claim 1, wherein said canvas frame comprises an adjustable cross arm with spaced-apart canvas holders located at respective opposite ends of the cross arm for engaging and holding the canvas.

11. An adjustable easel according to claim 10, wherein said cross arm comprises first and second spaced-apart, parallel segments received for individual sliding movement within respective sleeves.

12. An adjustable easel for supporting an artist's canvas, comprising:

(a) a base including a pair of spaced-apart front legs, a horizontal cross bar connecting the front legs together, and a rear leg attached to the cross bar; and a base frame including spaced-apart top and bottom segments and spaced-apart side segments attached to the top and bottom segments, said bottom segment including end pins engaging the front legs of said base to support said base frame in an adjustable upright position, (b) a rotatably adjustable canvas frame attached to the base frame for engaging the canvas and holding the canvas in a stable condition for painting, and said canvas frame comprising an adjustable cross arm with spaced-apart holders located at respective opposite ends for engaging and holding the canvas;

(c) a mounting pin interconnecting the base frame and the canvas frame together, and defining an axis of rotation about which the canvas frame rotates relative to the base frame; and (d) lock means cooperating with the mounting pin for releasibly locking said canvas frame in one of a plurality of predefined positions relative to the base frame.

13. An adjustable easel according to claim 12, wherein said base frame comprises a vertical center support attached to the top and bottom segments and located between the side segments, and said mounting pin being secured to the center support and said canvas frame for attaching said canvas frame to said base frame.

14. An adjustable easel according to claim 13, and including a spacer attached to the cross bar and to the vertical center support of said base frame to further support said base frame in a generally upright position.

15. An adjustable easel according to claim 14, wherein the length of said spacer is adjustable to allow forward and rearward pivoting movement of said base frame supported on the front legs of said base.

* * * * *